United States Patent [19]

Rogers, Jr.

[11] 4,261,574

[45] Apr. 14, 1981

[54] BOARD GAME

[76] Inventor: Thurmond J. Rogers, Jr., 7245 Fairbanks-North Houston Rd., Box 159, Houston, Tex. 77040

[21] Appl. No.: 106,409

[22] Filed: Dec. 26, 1979

[51] Int. Cl.[3] ..... A63F 3/00

[52] U.S. Cl. ..... 273/253; 273/146; 273/255

[58] Field of Search ..... 273/146, 243, 248, 249, 273/251, 252, 254, 255, 256, 258, 260–262, 278, 282, 283

[56] References Cited

U.S. PATENT DOCUMENTS

| | | | |
|---|---|---|---|
| 571,464 | 11/1896 | Truex | 273/258 |
| 972,382 | 10/1910 | Johnson-Jervis | 273/255 |
| 1,335,511 | 3/1920 | Leffargue | 273/258 |
| 1,480,360 | 1/1924 | Agee | 273/249 |
| 1,772,583 | 8/1930 | Barrett | 273/260 |
| 2,277,301 | 3/1942 | Channer | 273/255 |
| 2,557,583 | 6/1951 | Vitale | 273/255 |
| 2,729,451 | 1/1956 | Larson | 273/251 |
| 3,433,483 | 3/1969 | Ellis | 273/146 |
| 3,794,326 | 2/1974 | Bialek | 273/255 |
| 3,860,241 | 1/1975 | Leftin | 273/255 |
| 4,196,905 | 4/1980 | Yanari | 273/148 R |

FOREIGN PATENT DOCUMENTS

| | | | |
|---|---|---|---|
| 330088 | 2/1903 | France | 273/243 |
| 693586 | 9/1930 | France | 273/243 |
| 983553 | 2/1951 | France | 273/255 |
| 70189 | 10/1958 | France | 273/255 |
| 16341 | of 1887 | United Kingdom | 273/264 |
| 321219 | 3/1929 | United Kingdom | 273/260 |
| 1458913 | 12/1976 | United Kingdom | 273/260 |

*Primary Examiner*—Richard C. Pinkham
*Assistant Examiner*—R. Carl Moy
*Attorney, Agent, or Firm*—Neal J. Mosely

[57] ABSTRACT

A game apparatus comprising a novel game board and playing accessories is suitable for play by two persons in a short period of time. The game board comprises an elongated board divided into checkered squares of three different colors and having base strips at opposite ends of the board and a neutral strip across the center of the board from side to side. There are positioned at the base strips at opposite ends of the board the playing pieces of each player. The board simulates a space war. The playing pieces are of three distinct types, command ships, cargo ships and fighter ships. Movement of the pieces is first from the base strip onto the playing area of the board, with additional playing pieces being moved into the base strip as spaces are available. Movement of the pieces is determined by three dice having distinctive indicia. One die has the numerals 1, 2 and 3 thereon. A second die has indicia for the three different playing pieces. The third die has indicia for the colors of the board on which movement is permitted (movement is permitted on only two colors) and indicia indicating destruction of an opposing piece and the color of the square where such piece is located. Play continues until the opposing base is occupied or the two opposing command ship pieces are destroyed.

8 Claims, 8 Drawing Figures

BOARD GAME

BACKGROUND OF THE INVENTION

1. Field of the Invention

This invention relates to a new and useful improvements in board games and more particularly to board games involving the movement of playing pieces on a checkered board.

2. Brief Description of the Prior Art

Miller U.S. Pat. No. 1,595,906 discloses a game played on a board having a plurality of peripheral paths and a plurality of radial paths in which the playing pieces, shaped like a checker, are moved according to colored dice.

Haggard et al. U.S. Pat. No. 2,316,862 discloses a war game having a plurality of playing pieces movable between various playing spaces according to preselected rules.

Clark U.S. Pat. No. 3,649,022 discloses a board game having a plurality of paths of playing positions associated with marking of different colors and arranged with major and minor playing pieces movable according to a plurality of special dice.

Liston U.S. Pat. No. 3,709,498 discloses a board game apparatus including special apparatus for programing play.

Patterson U.S. Pat. No. 3,791,648 discloses a board game having a surface made up of circular spaces disposed about the board in 9 files and 12 ranks and playing pieces movable thereon according to the role of certain dice.

Comeaux U.S. Pat. No. 4,046,381 discloses a board game having a plurality of playing spaces arranged in a hierarchy and playing pieces movable according to a coded set of dice.

SUMMARY OF THE INVENTION

This invention relates to a new and improved board game simulating a war in outer space. The game comprises a game board having two distinct checkered areas with a neutral strip separating said areas and base strips at opposite ends of the board along the opposite ends of the checkered areas from the neutral strip. The base areas include a command base portion and a fleet base portion for movement of playing pieces on to the playing board. The checkered areas comprise a plurality of squares of equal size arranged in rectangular pattern and of three different colors, e.g. red, yellow and white or void. Alternate squares in each column and row, constituting half of the squares, are of one color, such as white or void, representing squares on which the playing pieces cannot move. The remaining squares are divided into squares of the other two colors arranged with squares of the same color lying along diagonal lines of squares alternating with diagonal lines of the other color and of the first named color. The game is played with three distinct types of playing pieces positioned initially at the end strip providing the fleet base portion or the command base portion. The playing pieces are of different color for each player. The playing pieces simulate in shape or indicia the command ship, a cargo ship and a fighter ship. Three distinctly different dice are used for directing movement of the playing pieces or the destruction or capture or opposing playing pieces. One die has two sets of the numerals 1, 2 and 3 on opposite sides thereof. The second die has indicia indicating each of the three types of playing pieces. The third die has four faces bearing the color or indicia of the color of each of the respective squares on which the playing pieces move. One color is on two opposite faces of the die and another color on two other opposite faces. The remaining two opposite faces bear indicia of the destruction of an opposing playing piece and one face is of one color and the other face of the other color of the squares on which the playing pieces move. The operation of the dice is the means for directing movement of the playing pieces and destruction of opposing pieces. The game is terminated when one side either occupies the other side's command base with at least three fighter ships or destroys both of the other side's command ships.

DESCRIPTION OF THE PREFERRED EMBODIMENTS

Figure 1:
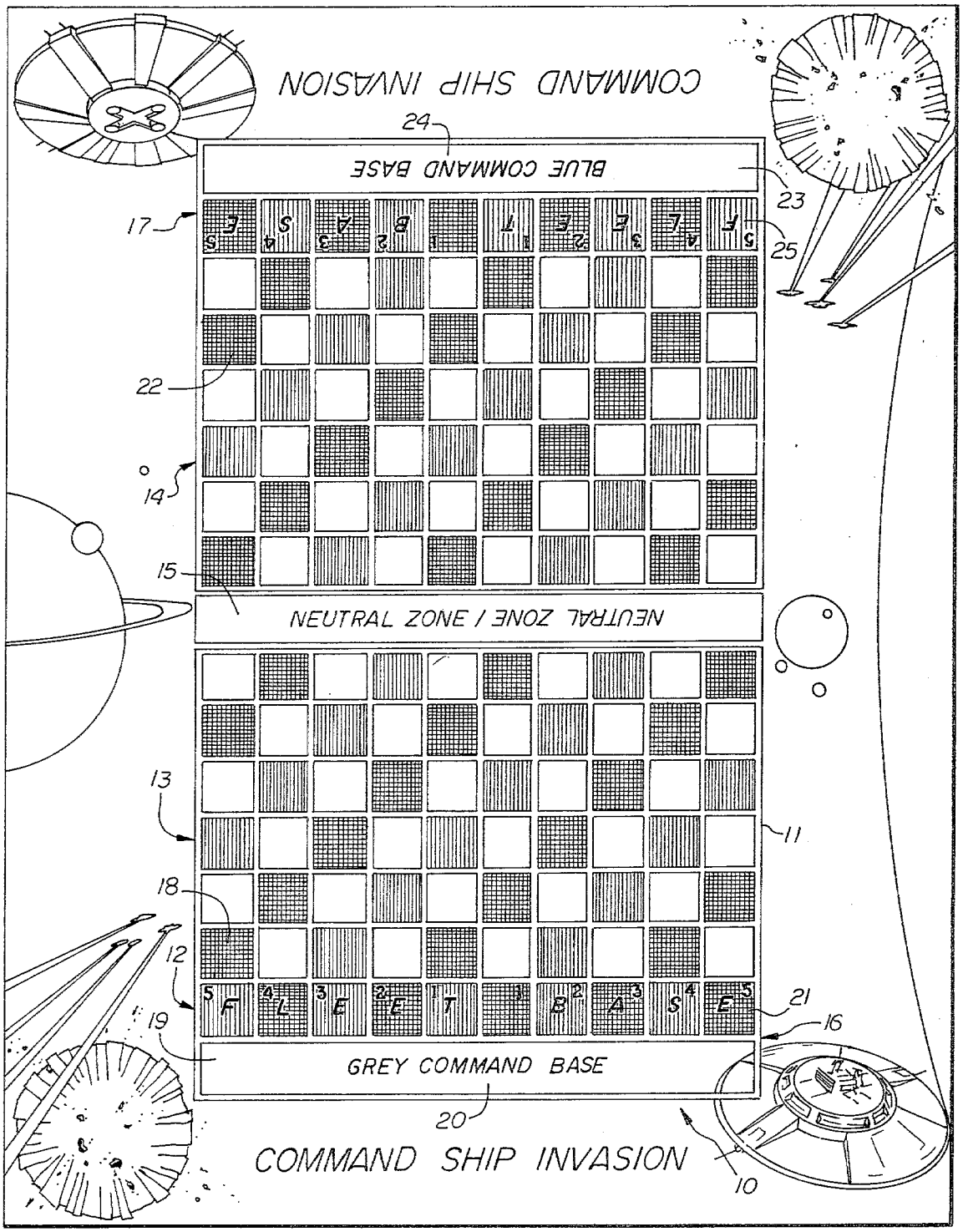
FIG. 1 is a plan view of the game board used in a preferred embodiment of this invention.
Figure 2:
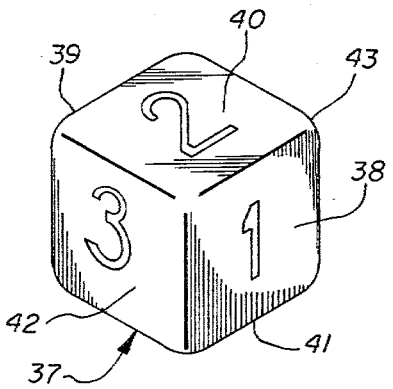
FIG. 2 is an isometric view of one of the play-directing dice, having numerals on the faces thereof.
Figure 3:
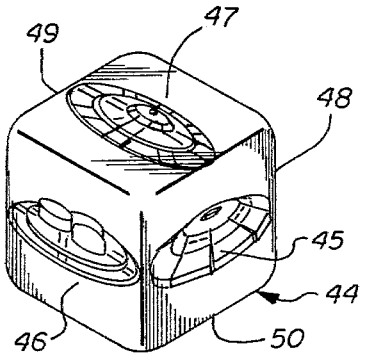
FIG. 3 is an isometric view of another of the play-directing dice, having fighter ship, cargo ship or command ship indicia thereon.

Referring to the drawing by numerals of reference, and more particularly to FIG. 1, there is shown a game board 10 of solid, sheet material, such as cardboard or the like. Game board 10 has a boundary line 11 enclosing a playing area and base area generally designated 12.

The game board is divided into two checkered areas 13 and 14 separated by a stripe 15 constituting a neutral zone. At opposite ends of the board are positioned stripes 16 and 17 which are base areas from which the playing pieces are initially moved.

Checkered playing area 13 consists of a plurality of squares 18 which are of equal size and comprise six rows of ten columns of squares. The squares 18 are of three different colors, viz. white or void, yellow and red and the colors are indicated by the initial letters of those colors. The checkered area consists of alternate white squares making up half of the area 13. The white or void squares are ones on which playing pieces are not permitted to move. The remaining squares are of red and yellow and are arranged with squares of the same color in diagonal rows alternating with diagonal rows of white or void squares and diagonal rows of the other color. In the particular board layout shown there are thirty white or void squares, sixteen yellow squares and fourteen red squares.

The base strip portion 16 is divided into two portions, a strip 19 representing a command base area and having a particularly designated command base portion 20 thereon. The other portion of the base strip is arranged in a plurality of squares 21 which are identified in size to the squares 18 in the main playing area 13. The squares 21 alternate red and yellow in color as indicated in the drawing. This area is indicated to be the fleet base. Also, the squares 21 to the left of the longitudinal center line are numbered from 1 to 5 as are the squares to the right of the center line.

The playing area 14 at the opposite end of the board has checkered squares 22 which are identical to the squares 18 and are arranged in the same manner with respect to color. Likewise, at the opposite end of the board the base stripe 17 is divided into a strip 23 which is the command base portion and a particularly designated command base area 24. There is also provided a fleet base strip consisting of squares 25 which alternate in color between red and yellow as in the case of the fleet base portion at the lower end of the board as viewed in FIG. 1.

The board may be decorated, as desired, with illustrations of space ships representing the types of ships used in the game, viz, command ship, cargo ship and fighter ship. It may also be decorated with illustrations of invader ships and destroyed ships. In this particular embodiment, the playing pieces on one side are of blue and on the other side are of gray.

Figure 5:
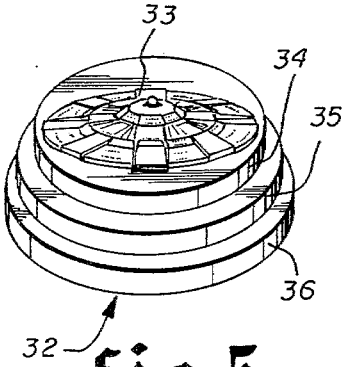
FIG. 5 is an isometric view of the playing piece representing a command ship.
Figure 6:
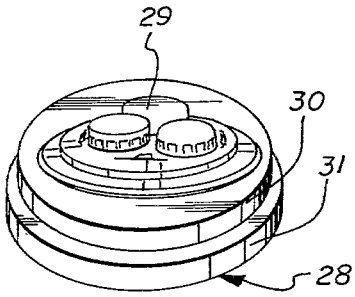
FIG. 6 is an isometric view of the playing piece representing a cargo ship.
Figure 7:
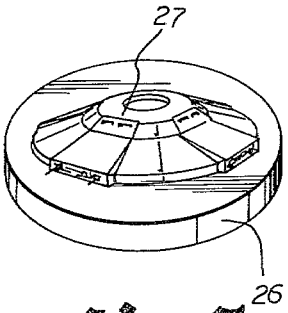
FIG. 7 is an isometric view of the playing piece representing a fighter ship.

In FIGS. 5, 6 and 7 there are shown isometric views of the playing pieces used in this board game. In FIG. 7 there is shown a playing piece 26 in the shape of a checker-like disc having indicia 27 indicating a fighter ship. In FIG. 6, the playing piece 28 is provided with indicia 29 indicating a cargo ship and consists of a smaller disc shaped piece 30 secured on an integral with a larger disc shaped piece 31. The other playing piece 32 bears indicia illustrating a command ship 33 and consists of a small disc 34 secured on an intermediate disc 35 which is turn secured on a larger disc 36. The discs 34, 35 and 36 are secured together as a single playing piece. The discs 26, 31 and 36 are preferably identical in size.

Figure 4:
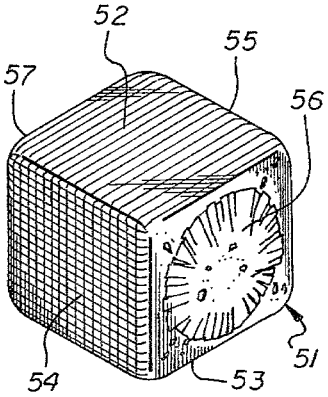
FIG. 4 is an isometric view of still another play-directing dice, having colors on certain faces thereof or indicia of space ship destruction and a color on a face thereof.

The dice used in moving the playing pieces 26, 28 and 32 are three different types. The first die 37 has the numeral 1 on opposite faces 38 and 39. It has the numeral 2 on opposite faces 40 and 41. It has the numeral 3 on opposite faces 42 and 43. The second die 44 has indicia of a fighter ship on four faces 45, 46, 47 and 48. It has indicia of a command ship on upper face 49. It has indicia of a cargo ship on bottom face 50 (not shown). The third die 51 carries indicia of the playing square colors, i.e. red and yellow. In the view shown in FIG. 4, the upper face 52 and lower face 53 are colored red. The left face 54 and right face 55 are colored yellow. The front face 56 is red and carries indicia of a destroyed space ship. The rear face 57 is colored yellow and carries indicia of a destroyed space ship.

Figure 8:
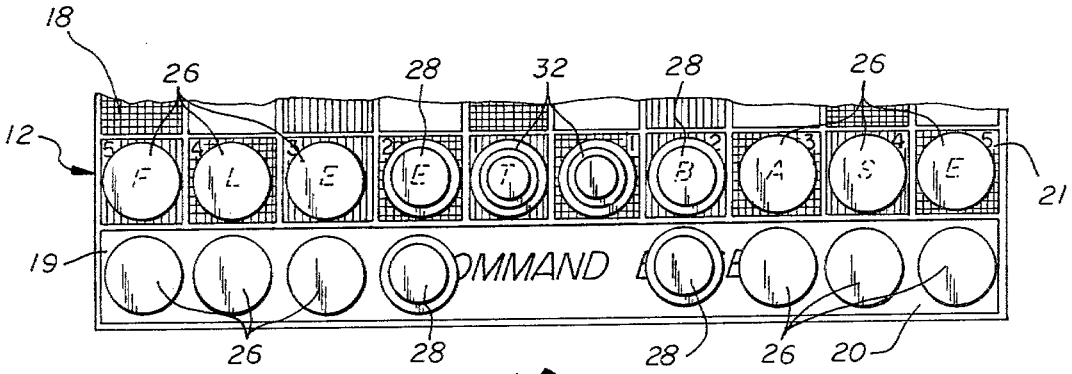
FIG. 8 in paln view of a fragment representing one end of the game board illustrating the initial position of the playing pieces thereon.

In FIG. 8, there is shown a standard set up of playing pieces for the start of the game. The game uses eighteen playing pieces consisting of two of the command ships 32, four of the cargo ships 28 and twelve of the fighter ships 26. In the initial set up, the two command ships 28 are positioned in squares one left and one right in the fleet base. Two of the cargo ships 28 are positioned in spaces or squares two left and two right in the fleet base. Three of the fighter ships 26 are positioned in squares three, four and five left and three fighter ships 26 are positioned in squares three, four and five right in the fleet base. Additional fighter ships 26 and cargo ships 28 are positioned in the command base strip 19 immediately behind the pieces of the same type in the fleet base.

PLAY OF THE GAME

At the start of the game, each player would choose the color of space ship playing pieces desired, e.g. blue or gray (or any other color which may be given to the playing pieces). The playing pieces indicating the space ships 26, 28 and 32 are positioned in the fleet base and command base as just described above.

Each player has two command ships 32 of his particular playing color. Command ships can destroy command ships of the other side on either side of the neutral zone strip 15 by a move of a playing piece. Command ships, however, cannot be destroyed by a throw of the dice (which will be described hereafter) as long as the command ship is not in opponent's territory. After a command ship has crossed the neutral zone, it can be destroyed by an appropriate roll of the dice.

A command ship can destroy another command ship or a cargo ship or a fighter ship. A command ship is permitted movement both forward and backward on both sides of the neutral zone. However, once a command ship crosses the neutral zone, it cannot move backwards into the neutral zone or into its own territory again. A command ship can move laterally on fleet base but cannot destroy another ship by such a lateral move. An opponent's space ship, of any kind, cannot move laterally on fleet base and then into command base on a single throw of the dice.

Each opponent has four of the cargo ships 28 of his selected playing color. Cargo ships can destroy cargo ships and fighter ships on both sides of the neutral zone 15 by either a forward or backward move depending upon the side of the neutral zone on which they are positioned. Cargo ships can be destroyed by an opponent by throw of the dice whether located on either side of the neutral zone. Cargo ships cannot move backward in their own playing area or territory. Cargo ships may move laterally on fleet base but cannot destroy other ships by such a move. Once a cargo ship crosses the neutral zone it cannot move backward into its own playing area or territory. A cargo ship must move forward by the exact number indicated by the dice in order to invade the opponent's command base. A cargo ship cannot move laterally on the opponent's fleet base and then invade the command base on a single throw of the dice. A cargo ship cannot destroy a command ship by a move.

Each player has twelve fighter ships 26 of his selected color. A fighter ship can destroy an opponent's fighter ship on a forward or backward move depending on the side of the neutral zone on which the ship is positioned. It cannot destroy a cargo ship or a command ship by any move. A fighter ship can move laterally on fleet base but cannot destroy another ship by such a lateral move. A fighter ship cannot move backwards into its own playing area or territory. A fighter ship cannot be destroyed in the neutral zone by a move or a throw of the dice. Once a fighter ship crosses the neutral zone it cannot move backwards into the neutral zone or its own playing area or territory. Once a fighter ship crosses the neutral zone into the opponent's playing area or territory it can move backwards as well as forward. A fighter ship can destroy fighter ships of the opponent on their own fleet base by a forward move only. A fighter ship and a cargo ship may destroy the opponent's ships by moving out of their own command base and landing on the exact number and color of square the opponent's ship is occupying.

The dice 37, 44 and 51 determine the procedure in which the game is played in advancing the space ship playing pieces 26, 28 and 32 forward or backward from one colored square to the next square and also destroying the opponent's space ship pieces. The numbered die 37 has the numerals one, two and three as described above. This die determines the exact number of squares that a player can move his space ship pieces forward or backward. The fleet die 44 has the three different types of space ship playing pieces on the sides thereof. There is one face having a command space ship, one face having a cargo space ship and four faces having fighter space ship indicia. This die determines the type of space ship that is to be moved from one square to the next. The fleet die 44 also determines the type of space ship that can be destroyed by movement of the color/destroy die 51. The color/destroy die 51 has two red colored faces and two yellow colored faces as previously described. These colors determine the color of the square to which a space ship playing piece can be moved. The red and yellow squares of the playing area are the only ones on which the space ship playing pieces can be moved and the pieces can move across yellow or red squares as long as the last square reached is the color thrown on the die. The two remaining faces of the color/destroy die 51 bear indicia of a destroyed space ship, one face being yellow and the other face being red. One side of the die is called Red Destroy Space Ship and the other is called Yellow Destroy Space Ship. The only function of these faces of the die is to indicate that a space ship of the opponent's has been destroyed if the opponent's space ship is occupying a square of that particular color on the playing board corresponding to the color shown on the color/destroy die 51. A player has the option of using the colored side of the die indicating destruction of an opposing space ship for moving his own space ship playing piece if that is to his strategic advantage.

The following examples illustrate movement of space ship playing pieces in accordance with the throw of the dice. In the first case, the dice are thrown. A fighter space ship shows on die 44, the fleet die, a 2 shows on die 37, the numeral die, and a red color shows on the color/destroy die 51. The dice would ordinarily be read out as "fighter 2 red" this means that the player will move one of his fighters two squares to end on a red square. Movement of the playing pieces would be within the limitations of movement described above for each of the respective playing pieces.

In a second example, the dice are thrown. On fleet die 44 a fighter space ship shows. A 2 shows on the numeral die 37. On the color/destroy die 51 the space ship destroyed shows on a red background. This sequence of dice would be read "fighter 2 red destroy." At this point, the player who that threw the dice has two options. If his opponent has a fighter on a red square he may destory the fighter by picking it up off the playing board and placing it in the area of the playing board for destroyed ships. If the opponent does not have a fighter on a red square, the player who threw the dice can play his other option by moving one of his fighters two squares ending on a red square. The same sequence of moves or destruction of pieces would apply if the ship shown on the fleet die 44 were a cargo ship or a command ship, with the limitation that a command ship may not be destroyed by a roll of the die before it has crossed the neutral zone into opponent's territory.

Movement of playing pieces 26, 28 and 32 from fleet base on to the playing board and across the board are in accordance with the throw of the dice. As squares are vacated on fleet base, it is then possible to move additional playing pieces from the command base strip 19 into the vacated squares for movement on to the playing portion of the board. When playing pieces reach the far side of the opponent's playing area they may enter the opponent's fleet base on direct moves and may move laterally within fleet base. Playing pieces may move into the opponent's command base on a direct forward move or on a lateral move followed by a forward move on a subsequent roll of the dice. Movement into the command base, fleet base or the neutral zone count as a single square on moving the playing pieces. Movement of playing pieces in the neutral zone may be made laterally without counting the lateral move, so that the piece may move forward according to the roll of the dice from any desired position in the opponent's territory.

Playing pieces of an opponent are destroyed by movement of one player's playing piece on to a square occupied by the opponent's playing piece, provided that the opponent's piece is one that can be attacked thereby. The limitations set forth above are that a command ship can destroy another command ship but cannot be destroyed by a fighter ship or a cargo ship. A cargo ship can destroy another cargo ship or a fighter but cannot be destroyed only other fighters. Playing pieces of all types can be destroyed by moves of the opponent's pieces as described above or by roll of the color/destroy die 51, as described above. All ships are safe in the neutral zone where they cannot be destroyed by a move or a throw of the dice. Likewise, a space ship cannot be destroyed while occupying its own fleet base strip by a throw of the color/destroy die 51 by the opponent. The space ship pieces must have a clear square or series of squares in which to move. At no time can a playing piece jump over another playing piece. It must either move to a clear square or must be capable of destroying the piece on the square to which it is to move.

The objective of the game is to destroy the maximum number of opponent's playing pieces and particularly to destroy opponent's command ships or to occupy the opponent's command base. A player wins the game when he has destroyed both of his opponent's command ships. A player may also win the game by occupying the opponent's command base with one of his command ships or two cargo ships or one cargo ship and two fighter ships or three fighter ships.

The game, as described, is a simple board game which is played by two players and takes a relatively short amount of time. The play of the game is determined by the throw of the numeral die 37, with the highest number thrown being the first to play. The play of the game is determined by the throw of the special dice 37, 44 and 51 and the tactics used by a player in moving his space ship playing pieces from square to square. The first objective is to occupy the neutral zone or strip 15 where the playing pieces are safe and a further line of offense can be planned. The player then continues forward to invade opponent's territory and eventually occupying the opponent's command base with a certain type of space ship or combination or number of space ships which will win the game as previously described. Once a player has destroyed both of opponent's command ships the game is over. The players take turns in throwing the dice and move space ship playing pieces in sequence only on the red and yellow squares. At the same time, tactics must be used in moving space ships to block and destroy opponent's space ships from invading his territory. At the same time, the player is attempting to invade the opponent's command base and win the game.

While this invention has been described fully and completely with special emphasis upon a single preferred embodiment, it should be understood that within the scope of the appended claims the invention may be practiced otherwise than as specifically described herein.

I claim:

1. A board game simulating a war in outer space comprising a game board having two distinct checkered areas with a neutral strip separating said areas and base strips at opposite ends of the board along the opposite ends of said checkered areas from said neutral strip, said checkered areas each comprising a plurality of squares of equal size arranged in rectangular pattern and of three different colors, alternate squares in each column and row, constituting half of the squares, being of one color, representing squares on which playing pieces cannot move, the remaining squares being divided approximately into equal numbers of squares of the other two colors, with squares of the same color lying along diagonal lines of squares alternating with diagonal lines of squares of the other color and of said first named color, three distinct types of playing pieces positioned initially in the end strips at opposite ends of the board and of different color for each player, said playing pieces simulating in shape or indicia a command ship, a cargo ship and a fighter ship, three distinctly different dice for directing movement of said playing pieces or the destruction or capture of opposing pieces, one die having two sets of the numerals 1, 2 and 3 on opposite sides thereof, a second die having indicia indicating each of the three types of playing pieces, with two indicia for each type of playing piece being positioned on opposite sides of the die, the third die having four faces bearing the color or indicia of the color of each of the respective squares on which the playing pieces move, one color being on two opposite faces and another color being on two other opposite faces, and the other two opposite faces bearing indicia of the destruction of an opposing playing piece, one face being of one color and the other of the other color of the squares on which said pieces move, and operation of said dice being the means of directing movement of playing pieces and capture of opposing pieces.

2. A board game according to claim 1 in which each of said base strips is divided into squares of a size equal to said first named squares and alternately colored in the color of the squares on which said playing pieces are moved.

3. A board game according to claim 1 in which said neutral strip is equal in width to the length on one side of one of said squares.

4. A board game according to claim 1 in which said base strips include a first strip on which predetermined playing pieces are positioned initially, and a second strip on which the remainder of said playing pieces are intitially positioned and from which such pieces may be moved in response to a throw of said dice.

5. A board game according to claim 4 in which the game is terminated by capture or destruction of both of the opposing player's comand ships or occupation of said second base strip of the opposing player by three fighter ships.

6. A board game according to claim 1 in which said playing pieces comprise a disc as a fighter ship, a pair of discs of different size, with the smaller disc secured on top of the larger disc, as a cargo ship, and a set of three discs of different sizes, secured together in order of decreasing size as a single playing piece, as a command ship.

7. A board game according to claim 1 in which said playing pieces are moved in response to the throw of the dice, a number of squares corresponding to the numeral showing on said one die, the playing piece being moved being that showing on the second die, and the square on which the move must terminate being of the color showing on the third die.

8. A board game according to claim 1 in which said playing pieces are moved in response to the throw of the dice:

a number of squares corresponding to the numeral showing on said one die, said playing piece being moved being the type showing on said second die, the square on which the move must terminate being of the color showing on said third die, and if said third die shows a ship destroyed of the color of one of the playing squares, an opposing piece of the type showing on said second die may be considered captured or destroyed if on a playing square of the indicated color.

* * * * *